US007241209B2

(12) United States Patent
Wiltshire et al.

(10) Patent No.: US 7,241,209 B2
(45) Date of Patent: Jul. 10, 2007

(54) ORBITING POLISHING TOOL

(75) Inventors: Frank Wiltshire, San Jose, CA (US); Jack Matsumoto, Sunnyvale, CA (US); Steve DelGrande, San Jose, CA (US); James Kasik, San Jose, CA (US)

(73) Assignee: General Electric Company, Schenectady, NY (US)

( * ) Notice: Subject to any disclaimer, the term of this patent is extended or adjusted under 35 U.S.C. 154(b) by 70 days.

(21) Appl. No.: 10/917,381

(22) Filed: Aug. 13, 2004

(65) Prior Publication Data

US 2007/0135026 A1 Jun. 14, 2007

(51) Int. Cl.
*B24B 11/00* (2006.01)

(52) U.S. Cl. ..... 451/180; 451/211; 451/357; 451/439

(58) Field of Classification Search ..... 451/180, 451/223, 121, 159, 163, 270, 271, 462, 135, 451/211, 27, 61, 439, 440, 441, 357; 409/66, 409/74, 132, 200; 82/1.11
See application file for complete search history.

(56) References Cited

U.S. PATENT DOCUMENTS 1,169,231 A * 1/1916 Boxhill ..... 451/440
1,219,827 A * 3/1917 Lescher ..... 451/440
2,608,807 A * 9/1952 Nilsen et al. ..... 451/440
2,738,627 A * 3/1956 Blagg ..... 451/440
3,718,168 A * 2/1973 Berends ..... 144/117.1
4,646,476 A * 3/1987 Yui ..... 451/360
5,545,079 A * 8/1996 Larsson et al. ..... 451/342
5,649,851 A * 7/1997 Boucherie ..... 451/139
5,899,795 A * 5/1999 Penza ..... 451/61
6,176,767 B1 * 1/2001 Heijkenskjold ..... 451/262
6,241,590 B1 * 6/2001 Heijkenskjold ..... 451/181
6,840,722 B1 * 1/2005 Nonaka ..... 409/132
7,018,272 B2 * 3/2006 Allaire et al. ..... 451/11

* cited by examiner

*Primary Examiner*—Jacob K. Ackun, Jr.
(74) *Attorney, Agent, or Firm*—Harness, Dickey & Pierce

(57) ABSTRACT

An orbiting polishing tool for at least one of polishing and material removal. The orbiting polishing tool may include a housing of a housing assembly rotatable about a first axis. The orbiting polishing tool may also include at least one abrasive wheel rotatable about a second axis, the at least one abrasive wheel configured to remove material from an inner surface of an object, wherein the second axis extends through the housing.

15 Claims, 3 Drawing Sheets

ORBITING POLISHING TOOL

BACKGROUND OF INVENTION

1. Field of the Invention

This invention relates generally to polishing tools and more particularly, an orbiting polishing tool for at least one of polishing and material removal from a target hole.

2. Description of Related Art

In a process of performing modifications or making repairs to internal components of a nuclear reactor, a machining of existing structures to remove remnants of removed components is often performed. One process for performing this machining is Electrical Discharge Machining (EDM). The EDM method utilizes an electrical current passed from an electrode to a target work piece base metal from which remnants are to be removed. This process leaves behind a thin recast layer on the machined work piece surface consisting of re-solidified base metal and electrode residue. This recast layer is extremely hard, rough, and may present undesirable micro-cracks, which extend into a base metal of the work piece. It is often necessary, in particular when the base metal of the work piece includes an Inconel alloy, to remove the recast layer and the attendant micro-cracks.

In the past, the recast layer has been removed by honing or by aggressive polishing with a suitable abrasive. Recast layer removal by conventional honing has been applied to both vertical and horizontal holes. Recast layer removal in a nuclear reactor environment typically requires tooling of significant power, robust construction, complex motions and actuations, and precise locating when installed. Cutting media of recast layer removal systems typically includes discrete stones with a complex mounting head capable of supporting the stones and accommodating the significant mechanical loads.

As the hole diameter of a work piece increases above approximately 3.00 inches, it may become more difficult, especially with horizontal centerline holes, to implement a hone given the space and accessibility constraints within the reactor. Additionally, the honing process requires a subsequent metallurgical examination of the surface to demonstrate that honing operation did in fact produce an acceptable surface condition. Recast layer removal by aggressive polishing has been implemented to remove as much as 0.050 diametrical inches for larger sized vertical centerline holes. The recast layer removal tooling typically features mechanisms that spatially position the polishing media, hold the tooling against the work piece surface, and provide the power necessary to rotate the media. In general, part of the motion required to polish a surface of the work piece is provided via a manual interface.

SUMMARY OF THE INVENTION

An exemplary embodiment of the present invention is directed to an orbiting polishing tool for at least one of polishing and material removal. The orbiting polishing tool may include a housing of a housing assembly rotatable about a first axis. The orbiting polishing tool may also include at least one abrasive wheel rotatable about a second axis, the at least one abrasive wheel configured to remove material from an inner surface of an object, wherein the second axis extends through the housing.

Another exemplary embodiment of the present invention is directed to an orbiting polishing tool for at least one of polishing and material removal. The orbiting polishing tool may include a housing rotatable about a first axis. The orbiting polishing tool may also include at least one abrasive wheel rotatable about the first axis and a second axis simultaneously, wherein the second axis extends through the housing.

BRIEF DESCRIPTION OF THE DRAWINGS

The present invention will become more apparent by describing, in detail, exemplary embodiments thereof with reference to the attached drawing, wherein like elements are represented by like reference numerals, which are given by way of illustration only and thus do not limit the exemplary embodiments of the present invention.

DETAILED DESCRIPTION OF THE EXEMPLARY EMBODIMENTS

Figure 1:
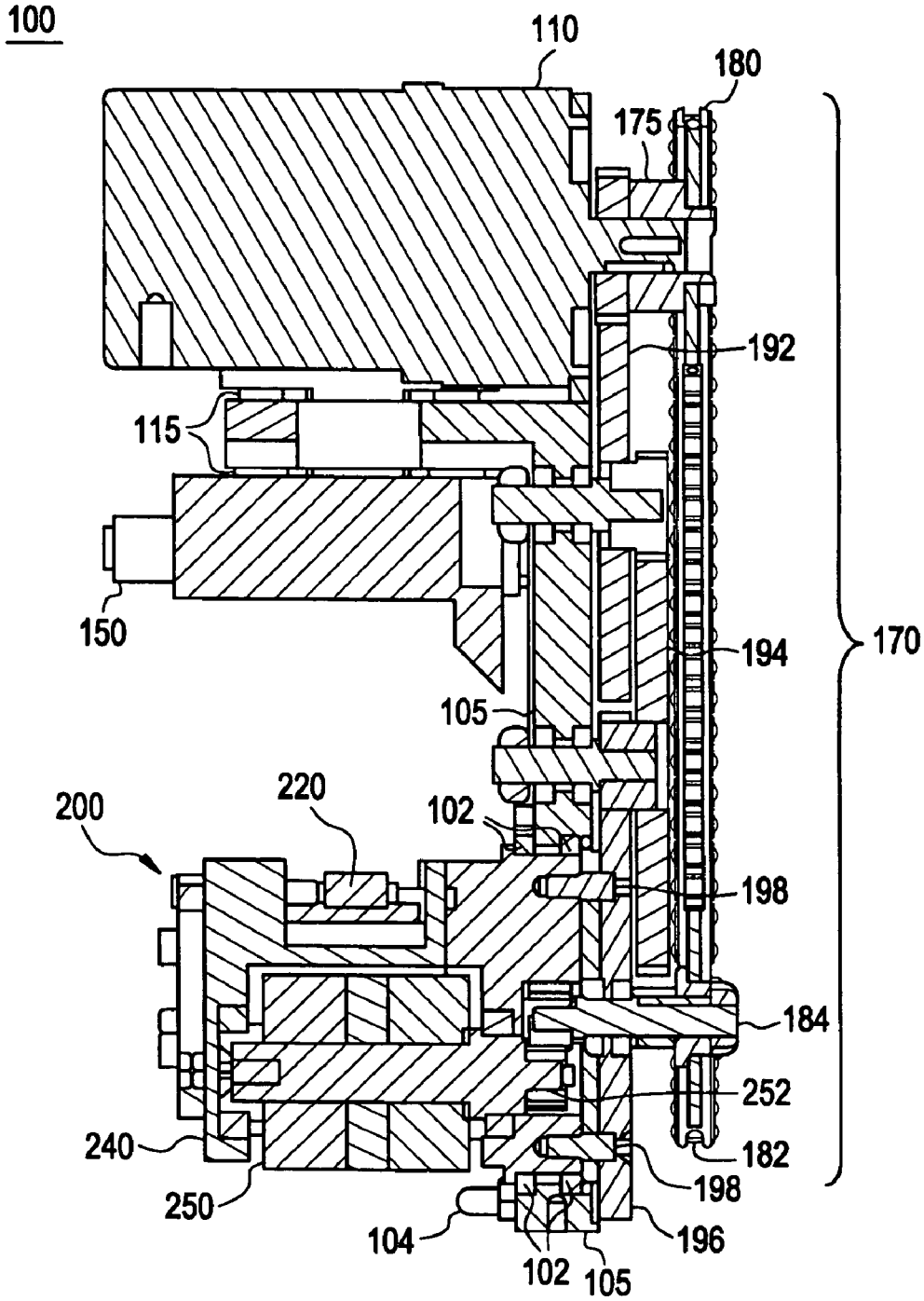
FIG. 1 is an example side sectional view of an orbiting polishing tool in accordance with an exemplary embodiment of the invention.

FIG. 1 is an example side sectional view of an orbiting polishing tool in accordance with an exemplary embodiment of the invention. The orbiting polishing tool 100 may be used to remove a recast layer (material layer) and/or polish the inner surface of a target hole of a work piece submerged in a liquid. While the work piece may be part of a nuclear reactor, the work piece may be any surface that has a target hole that needs a material layer removed and/or polishing. As shown in FIG. 1, the orbiting polishing tool 100 includes a tool base 105 that holds in place a motor 110, a housing assembly 200, driving components 170 and a tool mount 150, as discussed below.

Motor 110

As shown in FIG. 1, the motor 110 may provide rotational force to the driving components 170 which in turn rotate the housing assembly 200 and abrasive wheels 250 of the housing assembly 200. The motor 110 may be attached to the tool base 105 with mount springs 115. Moreover, the motor may be a hydraulic motor that is submersible in a liquid such as water. Alternatively, the motor 110 may be an electric, pneumatic, or other type of motor, as is known in the art, that turns an element in a particular direction.

Driving Components 170

As shown in FIG. 1, the driving components 170 of the orbiting polishing tool 100 may interact with the motor 110 to rotate the housing assembly 200 and the abrasive wheels 250 of the housing assembly 200. As shown in FIG. 1, the driving components 170 may include drives 175, 192, 194; shafts 184, 252; and a roller chain 180.

In operation, the motor 110 may turn the motor drive 175 in a first direction. The motor drive 175 may engage remaining driving components 170 to rotate the abrasive wheels 250 of the housing assembly 200 and the housing assembly 200 in a second direction. The first direction may be a clockwise motion while the second direction may be a counter clockwise motion, or vice versa. While the abrasive wheels 250 and the housing assembly 200 may rotate in the same direction using the above configuration, the abrasive wheels 250 and the housing assembly 200 may also turn in separate directions by removing or adding one or more of the driving components.

To turn the housing assembly 200 in the second direction, the motor drive 175, while turning in the first direction, may engage the connection drive 192 to turn the connection drive 192 in the second direction. The connection drive 192 may then engage the housing drive 194 to turn the housing drive 194 in the first direction. The housing drive 194 may then engage the housing gear 196 to turn the housing gear 196 in the second direction. The housing gear 196, attached to the housing assembly 200 using housing pins 198, may then turn the housing assembly 200 in the second direction. The housing gear 196 may use an abrasive wheel drive shaft 184 as an axle around which the housing gear 196 may slidingly revolve.

To turn the abrasive wheels 250 of the housing assembly 200 in the second direction, the motor drive 175, while turning in the first direction, may engage a roller chain 180 to turn the roller chain 180 in the first direction. The roller chain 180 may then engage an abrasive wheel drive gear 180 to turn an abrasive wheel drive shaft 184 in the first direction. The abrasive wheel drive shaft 184 may then engage the abrasive wheel driven shaft 252 to turn the abrasive wheel driven shaft 252 in the second direction. The abrasive wheel driven shaft 252 may then engage the abrasive wheels 250 to also turn the abrasive wheels 250 in the second direction.

Each of the drives 175, 192, 194 and housing gear 196 may be supported in place by the tool base 105 and include at least one gear that engages a gear of an adjacent drive. Additionally, motor drive 175 and abrasive wheel drive 182 may each include a sprocket to engage the roller chain 180. Alternatively, pulleys and belts may be used instead of the drives 175, 192, 194; the housing gear 196 and the roller chain 180.

The arrangement of the driving components 170 may allow for the placement and operation of the orbiting polishing tool 100 where a relatively small space is present between the target hole of the work piece and nearby obstructions. The arrangement of the driving components 170 also allows for the housing assembly 200 and the abrasive wheels 250 to turn at different speeds. For example, the abrasive wheels 250 may turn, with respect to the housing assembly 200, at a 44 to 1 ratio. That is, the abrasive wheels may turn 44 times faster than the housing assembly 200. The speed ratio may be adjusted by increasing or decreasing the size of any of the rotating driving components 170. A feature of the embodiment is that the driving components 170 rotate the housing assembly 200 in the same direction as the abrasive wheels 250. This allows the abrasive wheels 250 to rotate into the inner surface of the target hole 50 which may create a very efficient cutting polishing condition.

Housing Assembly 200

Figure 2:
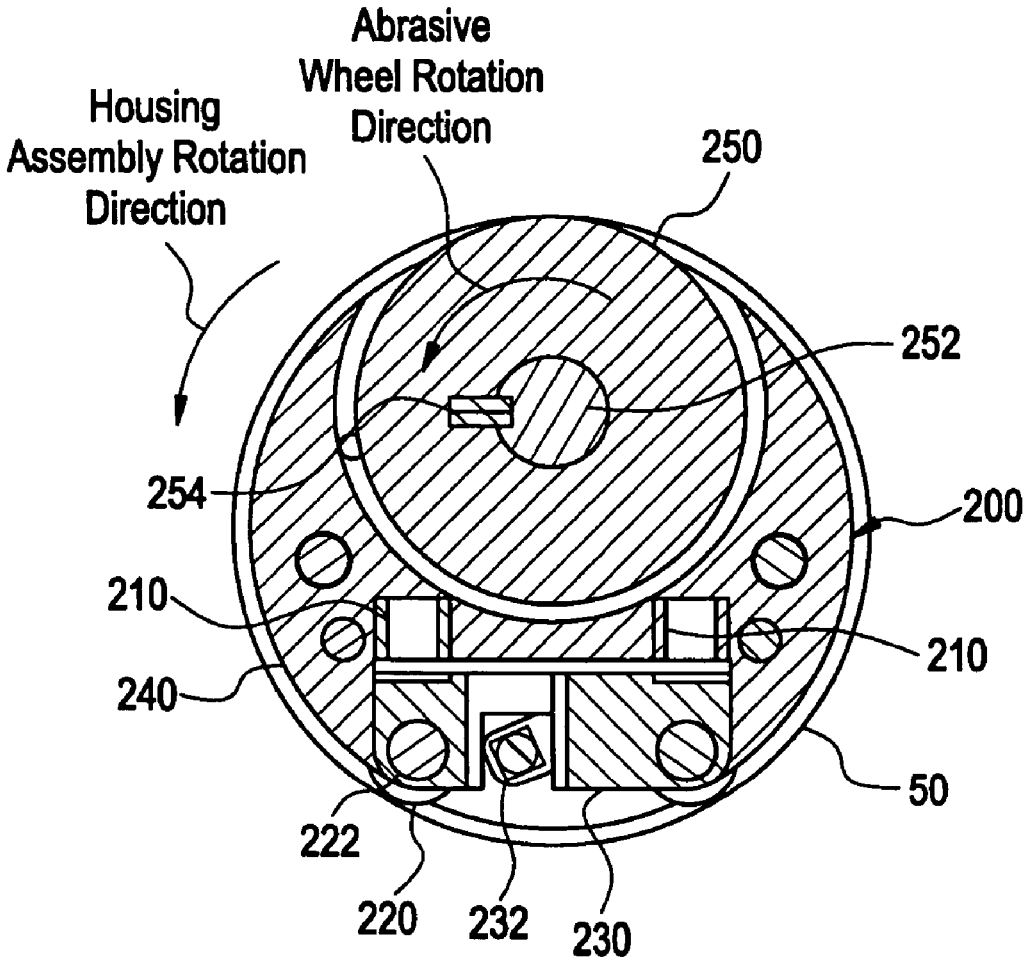
FIG. 2 is an example front sectional view of a housing assembly within a target hole in accordance with an exemplary embodiment of the invention.

FIG. 2 is an example front sectional view of a housing assembly within a target hole in accordance with an exemplary embodiment of the invention. As shown in FIG. 2, the housing assembly 200 of the orbiting polishing tool 100 may include abrasive wheels 250 that may be used to polish the inner surface of the target hole 50.

The housing assembly 200 may include three main groups of components: a carriage 230, a housing 240 and abrasive wheels 250. In the exemplary embodiment of FIG. 2, a portion of the housing assembly 200 is shown as being within a target hole 50. Following is a discussion of the carriage 230, the housing 240 and abrasive wheels 250.

The housing 240 of the housing assembly 200 may support the carriage 230 and the abrasive wheels 250. The housing may be connected to the housing gear 196 by housing pins 198 so that the housing assembly 200 along with the housing 240 may rotate about a first axis in cooperation with the motor 110. The housing 240 may be supported in the tool base 105 with housing bearings 102 of the tool base 105 while housing assembly 200 is stationary or rotates.

The carriage 230 of the housing assembly 200 may be attached to the housing 240 and may push the abrasive wheels 250 against the inner surface of the target hole 50 at an adjustable pressure. The pressure may be adjusted by modifying the tension of carriage load springs 210 until a desired pressure is reached. The carriage 230 may use at least one of the carriage load springs 210 to push load rollers 220 against the target hole 50 inner surface as the housing assembly 200 rotates within the target hole 50. This spring force helps assure that the abrasive wheels 250 remain in contact with the inner surface of the target hole 50 as abrasive wheels 250 reduce in diameter due to wear and the target hole 50 increases in diameter due to material layer removal and/or polishing. To help accommodate this changing geometry, the housing 240 may have an axis of rotation that is offset from the axis of symmetry of the target hole 50. As a result, the housing may rotate about an axis separate from the axis of the target hole 50 and its eccentricity may increase as the polishing proceeds.

As the housing assembly 200 rotates, the load rollers 220 roll along the inner surface of the target hole 50. The pressure applied to the inner surface of the target hole 50 by the load rollers 220 may allow the abrasive wheels 250 to be pushed against the inner surface of the target hole 50 so that the abrasive wheels 250 may remove a material layer from the target hole 50 and/or polish the inner surface of the target hole 50. Each load roller 220 may be held into position by a load roller axle 222. Moreover, pressure may be maintained against the inner surface of the target hole 50 until a given diameter of the target hole 50 is clear of material to be removed.

A carriage cam 232 in a lever configuration may be used to retract the carriage 230 to allow for insertion/removal of the carriage 230 to/from the target hole 50. Alternatively, when the carriage 230 is in its proper position within the target hole 50, the cam may be engaged to allow the carriage 230 to apply the adjusted pressure against the inner surface of the target hole 50.

The abrasive wheels 250 of the housing assembly 200 may provide an abrasive force to the inner surface of the target hole 50 to remove the unwanted remnants from the target hole 50. As shown in FIG. 2, three wheels are used, however, more or less may also be used. The abrasive wheels 250 may be made of an abrasive element such as sand particles or other materials known in the art for polishing. The abrasive wheels 250 may be supported by the housing 240 and the abrasive wheel driven shaft 252 such that most of each abrasive wheel 250 is within the housing 240. Bearings (not shown) within the housing 240 may assist the abrasive wheels 250 when rotated about a second axis that extends through the housing 240. The first axis of the housing and the second axis of the abrasive wheels 250 may be in different planes, that is, not co-linear. In such a configuration, the abrasive wheels 250 may spin at a high speed and the rotational speed of the housing assembly 200 can be maintained at a lower speed. The abrasive wheels 250 may be rotated by the abrasive wheel driven shaft 252 in cooperation with the driving components 170 and the motor 110. The abrasive wheels 250 may further be held to the abrasive wheel driven shaft 252 with a key 254 to help prevent the abrasive wheels 250 from slipping on the abrasive wheel driven shaft 252. As the material layer removal and/or polishing proceeds, the carriage load springs 210 extend and force the carriage 230 outward in a radial direction. As a result, the housing assembly 200 self-adjusts pressures against the carriage 230 and may allow the orbiting polishing tool 100 to operate without operator intervention during a material layer removal and/or polishing process. This movement of the carriage 230 may reduce the carriage load spring 210 force and the loading on the abrasive wheels 250. As a possible result of the material layer removal and/or polishing progressing, the material layer removal and/or polishing process may become less aggressive and the surface finish of the target hole 50 may become more fine. Moreover, the material layer removal and/or polishing process may be self-limiting in that the material layer removal and/or polishing decreases as the abrasive wheel 250 wears down and the target hole 50 size increases. This wearing and target hole 50 increasing may be advantageous as it may allow the amount of material layer removal and/or polishing to be determined by a time duration. For example, the orbiting polishing tool 100 may be set and operate for 10 hours without negative effects even if a material layer removal and/or polishing is complete at 8 hours. Stops may also be added to the housing assembly 200 to limit the absolute outward motion of the carriage 230.

Tool Mount 150

Figure 3:
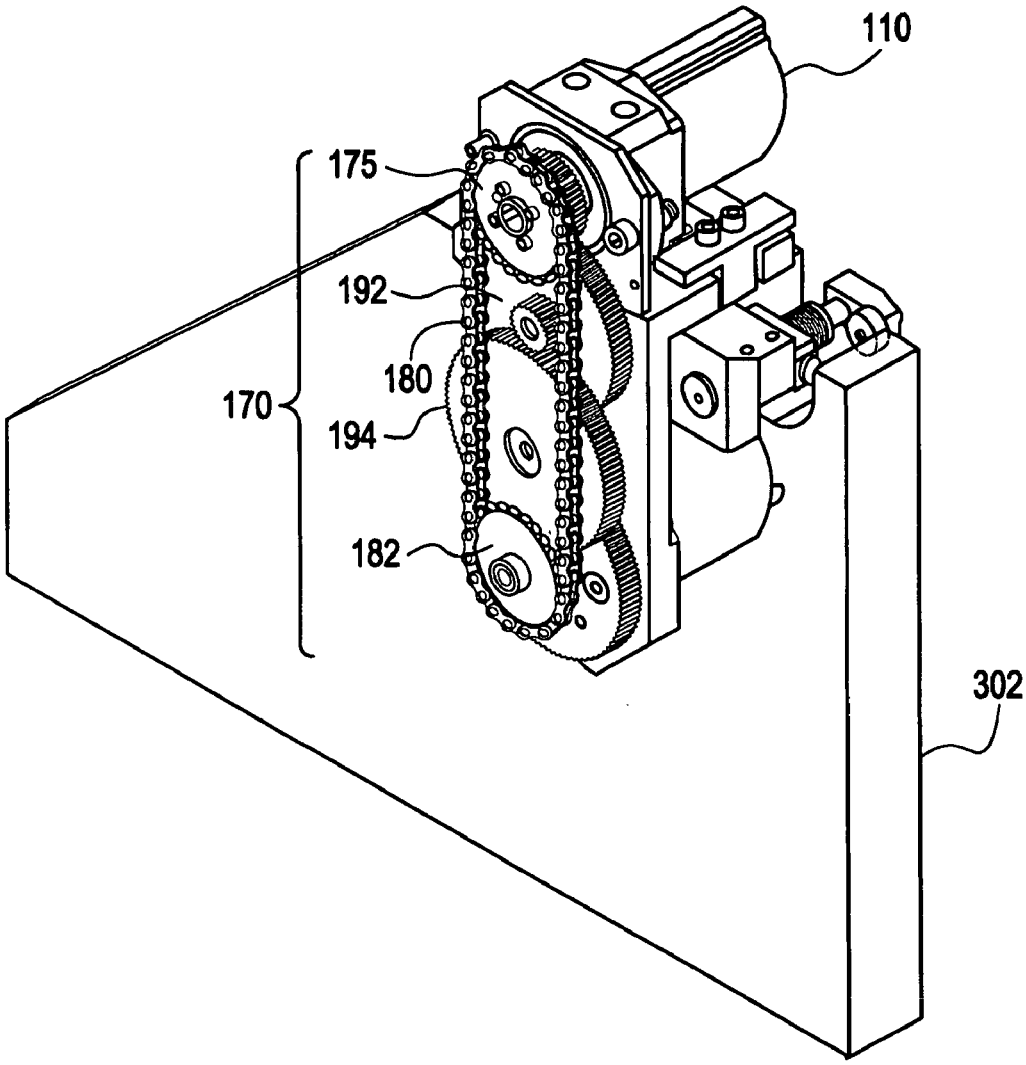
FIG. 3 is a detailed plan view of an orbiting polishing tool operating on a work piece in accordance with an exemplary embodiment of the invention.

FIG. 3 is a detailed plan view of an orbiting polishing tool operating on a work piece in accordance with an exemplary embodiment of the invention.

As shown, for example, in FIGS. 1 and 3, the tool mount 150 may be attached to the tool base 105 and supported against the tool base 105 with mount springs 115. The tool mount 150 may be used to hold the orbiting polishing tool 100 in place against the work piece 302. The tool mount 150 may be securely fastened to an edge of the work piece 302 so that the orbiting polishing tool 100 may be properly positioned and stable during operation. A positional stop 104 of the tool base 105 may work in conjunction with the tool mount 150 to provide stability.

A feature of the present invention is that the housing assembly 200 may maintain an eccentric rotation. That is, the housing assembly 200 may wobble within the target hole 50 while in operation. As shown, for example, in FIG. 1, to assist in the eccentric rotation, the tool base 105 may be floated on the tool mount 150 through an array of mount springs 115. The mount springs 115 may be positioned above and below the tool base 105 and may be preloaded. The mount springs 115 may be selected to provide a proper amount of compliance (resistance to slowly applied loadings) and a dynamic response (resistance to rapidly applied loadings). The mount springs 115 may also permit the tool base 105 to move with six degrees of freedom. Any of these degrees of freedom may, however, be eliminated through the use of stops as desired to satisfy functional requirements of the tool. In the exemplary embodiment of FIG. 1, a positional stop 104 is provided to restrain the linear motion of the orbiting polishing tool 100 in the direction of the target hole 50 centerline. This may assure that the abrasive wheels are properly located when the orbiting polishing tool 100 is clamped in place. The mount clamp 150 may permit the orbiting polishing tool 100 to adjust for positional errors as may occur during remote installation and as the target hole 50 and the abrasive wheels 250 change size during operation. Enhancements of the mount springs 115 relative to the weight of the spring-supported components, allows the orbiting polishing tool 100 to be tuned so as to be unresponsive to the lower, high energy, frequencies arising from the rotational speeds within the orbiting polishing tool 100. The frequencies in the exemplary embodiment may be maintained above the motor 110 speed.

The above described orbiting polishing tool 100 may be suitable for material layer removal from a target hole 50 and/or polishing of the target hole 50 located in difficult to access regions within a nuclear power plant. Advantages of the present invention are that the orbiting polishing tool 100 is that it facilitates the remote installation of the orbiting polishing tool 100, it is self-centering within the target hole 50, it maintains a controlled material layer removal and/or polishing of a target hole 50, and it may include self-limits for the amount of a material layer that may be removed from the target hole 50. Further, the present invention may permit the material layer removal and/or polishing to proceed without the intervention of an operator except maybe as required to switch power to initiate or terminate the operation. While the present invention may have been developed for recast layer removal, the invention may be applicable to a situation where it is desired to remove a material layer from a target hole and/or polish the inner surface of the target hole. Additionally, while the present invention addresses holes in metallic structures, it may be applicable to other materials after proper selection of the abrasive wheel material.

While the invention has been described in terms of various embodiments, those skilled in the art will recognize that the exemplary embodiments of the present invention can be practiced with modification within the spirit and scope of the claims.

What is claimed is:

1. An orbiting polishing tool for at least one of polishing and material removal, comprising:

a housing assembly including a housing and at least one abrasive wheel, the housing and housing assembly rotatable about a first axis, the at least one abrasive wheel rotatable about a second axis, the second axis being on a different axis than the first axis, and the at least one abrasive wheel configured to remove material from an inner surface of an object; and a motor that rotates the at least one abrasive wheel and the housing, wherein the second axis extends through the housing and is parallel to the first axis.

2. The orbiting polishing tool of claim 1, further comprising:

a plurality of rollers configured to apply pressure against the inner surface of the object so that the at least one abrasive wheel contacts the inner surface of the object.

3. The orbiting polishing tool of claim 1, further comprising:

a tool mount connected to the housing assembly and configured to contact an outer surface of the object.

4. The orbiting polishing tool of claim 1, wherein the at least one abrasive wheel is configured to terminate removing material from the inner surface of the object without user intervention.

5. The orbiting polishing tool of claim 1, wherein the housing assembly causes the at least one abrasive wheel to maintain pressure against the inner surface of the object until a given diameter of the object is clear of material to be removed.

6. The orbiting polishing tool of claim 1, wherein the first and second axes are in different planes.

7. The orbiting polishing tool of claim 1, wherein the at least one abrasive wheel rotates about the second axis at a different speed than the housing rotates about the first axis.

8. The orbiting polishing tool of claim 1, wherein the at least one abrasive wheel and the housing rotate in the same direction.

9. The orbiting polishing tool of claim 1, wherein the at least one abrasive wheel and the housing rotate in different directions.

10. The orbiting polishing tool of claim 1, wherein a substantial portion of the at least one abrasive wheel is within the housing.

11. An orbiting polishing tool for at least one of polishing and material removal, comprising:

a housing rotatable about a first axis; and at least one abrasive wheel rotatable about the first axis and a second axis simultaneously, the first axis and second axis are each on a different axis, wherein the second axis extends through the housing and is parallel to the first axis, and a substantial portion of the at least one abrasive wheel is within the housing.

12. An orbiting polishing tool for at least one of polishing and material removal, comprising:

a housing assembly including a housing rotatable about a first axis and at least one abrasive wheel rotatable about a second axis of the housing configured to remove material from an inner surface of an object, the first axis being on a different axis than the second axis, the second axis extending through the housing and is parallel to the first axis; and a plurality of rollers configured to apply pressure against the inner surface of the object so that the at least one abrasive contacts the inner surface of the object.

13. An orbiting polishing tool for at least one of polishing and material removal, comprising:

a housing assembly including a housing rotatable about a first axis and at least one abrasive wheel rotatable about a second axis of the housing configured to remove material from an inner surface of an object, the first axis being on a different axis than the second axis, the second axis extending through the housing and is parallel to the first axis, and a substantial portion of the at least one abrasive wheel being within the housing.

14. An orbiting polishing tool for at least one of polishing and material removal, comprising:

a housing rotatable about a first axis;

at least one abrasive wheel rotatable about a second axis configured to remove material from an inner surface of an object, the second axis being on a different axis than the first axis; and a carriage configured to control an amount of pressure applied between the at least one abrasive wheel and the inner surface of the object.

15. The orbiting polishing tool of claim 14, wherein the carriage comprises a plurality of rollers configured to apply pressure against the inner surface of the object causing the at least one abrasive wheel to contact the inner surface of the object.

* * * * *